US007934567B1

(12) United States Patent
Madey

(10) Patent No.: US 7,934,567 B1
(45) Date of Patent: May 3, 2011

(54) DRIVING APPARATUS FOR PLANTING A SHAFT IN A GRANULAR BASE

(76) Inventor: John Madey, Jupiter, FL (US)

( * ) Notice: Subject to any disclaimer, the term of this patent is extended or adjusted under 35 U.S.C. 154(b) by 272 days.

(21) Appl. No.: 12/340,014

(22) Filed: Dec. 19, 2008

Related U.S. Application Data

(60) Provisional application No. 61/075,478, filed on Jun. 25, 2008.

(51) Int. Cl.
*B23B 45/16* (2006.01)

(52) U.S. Cl. ..... 173/90; 173/132; 173/92; 173/91

(58) Field of Classification Search ..... 173/90, 173/91, 92, 132
See application file for complete search history.

(56) References Cited

U.S. PATENT DOCUMENTS

| | | | | | |
|---|---|---|---|---|---|
| RE15,669 | E | * | 8/1923 | Hindmarsh | 173/130 |
| 1,736,177 | A | | 11/1929 | Snook | |
| 1,943,018 | A | | 1/1934 | Hench | |
| 2,103,948 | A | | 12/1937 | Jones | |
| 2,211,283 | A | | 8/1940 | Mercer | |
| 2,525,316 | A | | 10/1950 | Schiff | |
| 2,629,985 | A | | 3/1953 | McDowell | |
| 2,690,055 | A | | 9/1954 | Lundgren et al. | |
| 2,759,486 | A | | 8/1956 | Pesaturo | |
| 3,117,378 | A | * | 1/1964 | Bowen | 33/293 |
| 3,519,234 | A | | 7/1970 | Matson | |
| 3,744,503 | A | | 7/1973 | Wolff et al. | |
| 3,823,785 | A | | 7/1974 | Toliver | |
| 4,261,424 | A | * | 4/1981 | Gonterman et al. | 173/91 |
| 4,438,769 | A | * | 3/1984 | Pratt et al. | 227/175.1 |
| 4,459,787 | A | | 7/1984 | Wilcox | |
| 4,753,411 | A | | 6/1988 | Lechner et al. | |
| 4,832,304 | A | | 5/1989 | Morgulis | |
| 4,924,893 | A | | 5/1990 | Furey | |
| 5,029,651 | A | | 7/1991 | Ubbink | |
| 5,046,699 | A | | 9/1991 | Perreault et al. | |
| 5,097,912 | A | * | 3/1992 | Bowers | 173/90 |
| 5,122,014 | A | | 6/1992 | Genfan | |
| 5,152,495 | A | | 10/1992 | Jacinto et al. | |
| 5,156,369 | A | | 10/1992 | Tizzoni | |
| 5,207,406 | A | | 5/1993 | Stine et al. | |
| 5,271,196 | A | | 12/1993 | Fanti | |
| 5,427,346 | A | | 6/1995 | Urgola | |
| 5,452,877 | A | | 9/1995 | Riffle et al. | |
| 5,482,246 | A | | 1/1996 | Derkoski | |
| 5,495,878 | A | * | 3/1996 | McKenen, Jr. | 144/195.5 |
| 5,535,978 | A | | 7/1996 | Rodriguez et al. | |
| 5,639,057 | A | | 6/1997 | Yeomans | |
| 5,988,194 | A | | 11/1999 | Collins | |
| 6,050,034 | A | | 4/2000 | Krinner | |
| 6,199,569 | B1 | | 3/2001 | Gibson | |
| 6,267,127 | B1 | | 7/2001 | Doreste | |
| 6,308,468 | B1 | | 10/2001 | Caruso | |

(Continued)

*Primary Examiner* — Brian D Nash
(74) *Attorney, Agent, or Firm* — Gold & Rizvi, P.A.; Glenn E. Gold; H. John Rizvi

(57) ABSTRACT

A driving apparatus is disclosed for planting a vertically oriented shaft into a granular base. The driving apparatus includes an anvil integrally formed at an intermediate location on the shaft. A weight is attached on the shaft, above the anvil, in freely slidable engagement. The shaft is provided with a tapered lower end. With the lower end positioned adjacent to the granular base, the weights may be repeatedly propelled against the anvil, by sliding along the shaft in a hammering motion, to drive the shaft into the base. The shaft may serve to support an article such as a beach umbrella.

19 Claims, 5 Drawing Sheets

U.S. PATENT DOCUMENTS

| | | | | |
|---|---|---|---|---|
| 6,328,046 | B2 | 12/2001 | Doreste | |
| 6,347,672 | B1 * | 2/2002 | Reardon | 173/90 |
| 6,354,554 | B1 | 3/2002 | Hollenbeck | |
| 6,412,748 | B1 | 7/2002 | Girard | |
| 6,474,198 | B2 * | 11/2002 | Lowther | 81/27 |
| 6,899,187 | B1 | 5/2005 | McCarthy | |
| 6,953,180 | B1 | 10/2005 | Ruvalcaba et al. | |
| 7,246,783 | B2 | 7/2007 | Harold et al. | |
| 2002/0139548 | A1 * | 10/2002 | Connelly, Jr. | 173/90 |
| 2002/0175262 | A1 | 11/2002 | Brooks, III | |
| 2003/0070821 | A1 * | 4/2003 | McPhillips | 173/90 |
| 2006/0060587 | A1 | 3/2006 | Shukrie | |
| 2006/0272687 | A1 | 12/2006 | Tanner et al. | |
| 2007/0204896 | A1 | 9/2007 | Gereke-King | |

* cited by examiner

DRIVING APPARATUS FOR PLANTING A SHAFT IN A GRANULAR BASE

REFERENCE TO RELATED APPLICATIONS

This application claims the benefit of co-pending U.S. Provisional Patent Application Ser. No. 61/075,478, filed on Jun. 25, 2008, which is incorporated herein in its entirety.

BACKGROUND OF THE INVENTION

1. Field of the Invention

The present invention generally relates to apparatus for planting a shaft in a base, for supporting the shaft in a generally vertical orientation, and particularly to apparatus for driving a shaft into a granular base. The vertically oriented shaft may be used to support an umbrella or other structure.

2. Description of the Prior Art

A vertical support member planted in a base is a common element of many static structures. A vertical support member may be planted in a soil base by digging a hole, setting the support member, and filling the hole. A vertical support member may also be driven into the soil base by positioning the support member at a desired location and repeatedly hammering the support member, to advance the support member into the soil. When hammering a support member, it is common practice to place a drive cap on the upper end of the support member to avoid deforming the support member during hammering, so that the shape of the support member will be preserved to facilitate the attachment of other structural elements.

When individuals visit a beach, for recreation, temporary static structures, such as umbrellas, sports equipment, and flagpoles are often erected. These structures are typically supported by a shaft planted in the granular base of beach sand. The granular nature of the sand makes planting of a shaft relatively easy and several methods may be used. A hole may be hand dug, the shaft may be placed in the hole and the hole may be refilled. Mounting sleeves are available with a spiral shaped rod projecting from a lower end. The sleeve may be turned, in the manner of a corkscrew, to advance the sleeve into the base. The upper portion of the sleeve is provided with an opening for receiving the center pole of an umbrella or other article. Finally, articles, which may be disassembled to separate a lower portion of the shaft from the article, may be planted by hammering the lower portion of the shaft into the base and subsequently reassembling the article to support the umbrella or other article overhead.

The various methods of planting a shaft in a granular base have certain drawbacks. The process of hand digging a hole can be somewhat tedious. Below the surface of the beach, the sand becomes moist and more compacted. Digging a hole of sufficient depth to support the article is difficult and inconvenient. The mounting sleeve, with the spiral rod, is relatively easy to plant but the device must be carried and stored. When individuals visit the beach, it is desirable to minimize the amount of items, which must be carried. The method of driving the shaft into the base requires a hammer and perhaps a drive cap to protect the top of the shaft, both which items must be carried.

There is a need for a simple and convenient apparatus for planting a shaft in a granular base.

There is a need for a driving apparatus that is integrated with the shaft to be driven into the granular base.

There is a need for a driving apparatus, which is detachable from the shaft to be driven.

There is a need for a driving apparatus, which facilitates removal of the shaft from a granular base.

SUMMARY OF THE INVENTION

The present invention is directed to a driving apparatus for planting a shaft of an article in a granular base. The driving apparatus includes an anvil assembly, a weight, and attaching means. The anvil assembly is fixedly disposed on the shaft, at an intermediate location. The shaft is positioned in vertical orientation and is provided with a tapered lower end. The weight is retained on the shaft above the anvil assembly in freely slidable engagement by the attaching means. The shaft may be positioned with the tapered end adjacent to the base, at a desired location. The weight may be repeatedly propelled against the anvil assembly for driving the shaft into the base. The weight may be detachable, for convenience and the shaft may be separable from the article to be supported or the shaft may be an integral part of the article. A stop means may be fixedly disposed on the shaft above the weight, against which the weight may be repeatedly propelled, for facilitating removal of the shaft from the base.

It is an object of the present invention to provide a simple and convenient apparatus for driving a shaft into a granular base.

It is another object of the present invention to provide an integral driving apparatus for driving a shaft into a granular base.

It is a further object of the present invention to provide a driving apparatus having a detachable weight.

It is yet another object of the present invention to provide a driving apparatus which may be driven upward to facilitate removal of the shaft from a sand base.

These and other objects, features and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Figure 1:
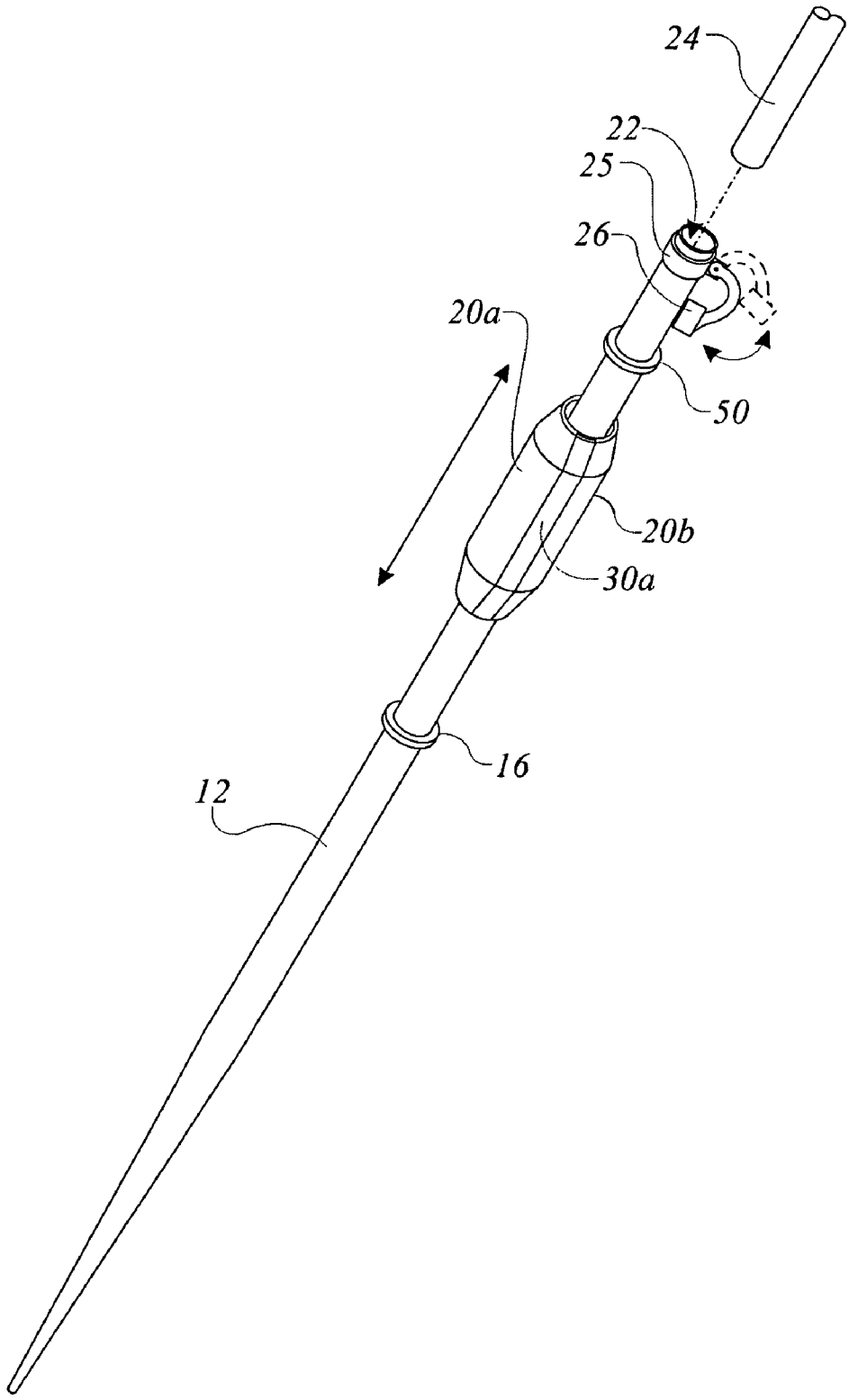
FIG. 1 is a top perspective view of the driving apparatus of the present invention.

Shown throughout the drawings, the present invention is a driving apparatus for planting a shaft of an article in a granular base. FIG. 1 shows a preferred embodiment of the present invention. A shaft 12 is shown in generally vertical orientation. An anvil assembly preferably comprising a single anvil 16 is fixedly disposed at an intermediate location on the shaft 12. A weight comprising half-sections 20*a* and 20*b* is attached, by attaching means, to the shaft 12 above the anvil 16. The shaft 12 is preferably provided with a tapered lower end to facilitate penetration into a granular base. The upper end of the shaft 12 is provided with an opening 22 having a circular cross-section for receiving a central pole 24 of a beach umbrella, in sliding engagement. The shaft 12 is preferably formed of aluminum, steel, a steel alloy, or other lightweight metal or metal alloy. The shaft 12 is provided with retaining means, such as a band clamp 25 surrounding the shaft 12 proximate to the opening 22 and having a rotating latch 26 with a cam (not shown) to increase tension on the band clamp 25 to constrict the shaft 12, for retaining the central pole 24, in the opening 22. It is intended that other conventional retaining means may be provided to retain the central pole 24 in engagement within the opening 22.

The attaching means secures the weight on the shaft 12, in freely slidable engagement, as indicated, by a double-headed arrow, in FIG. 1. The half-sections 20*a* and 20*b*, comprising the weight, are preferably formed of iron, steel, or other relatively dense and non-malleable metal, but may also be formed of a lightweight metal, such as aluminum, or of plastic. The anvil 16 is preferably formed of aluminum, steel, or other metal or metal alloy. The weight may be propelled against the anvil 16 for driving the shaft 12. It is preferred that the anvil 16 be integral with the shaft 12 or firmly attached, by a method such as welding, so as to elastically transmit kinetic energy, from a blow by the weight, to the shaft 12.

Figure 2:
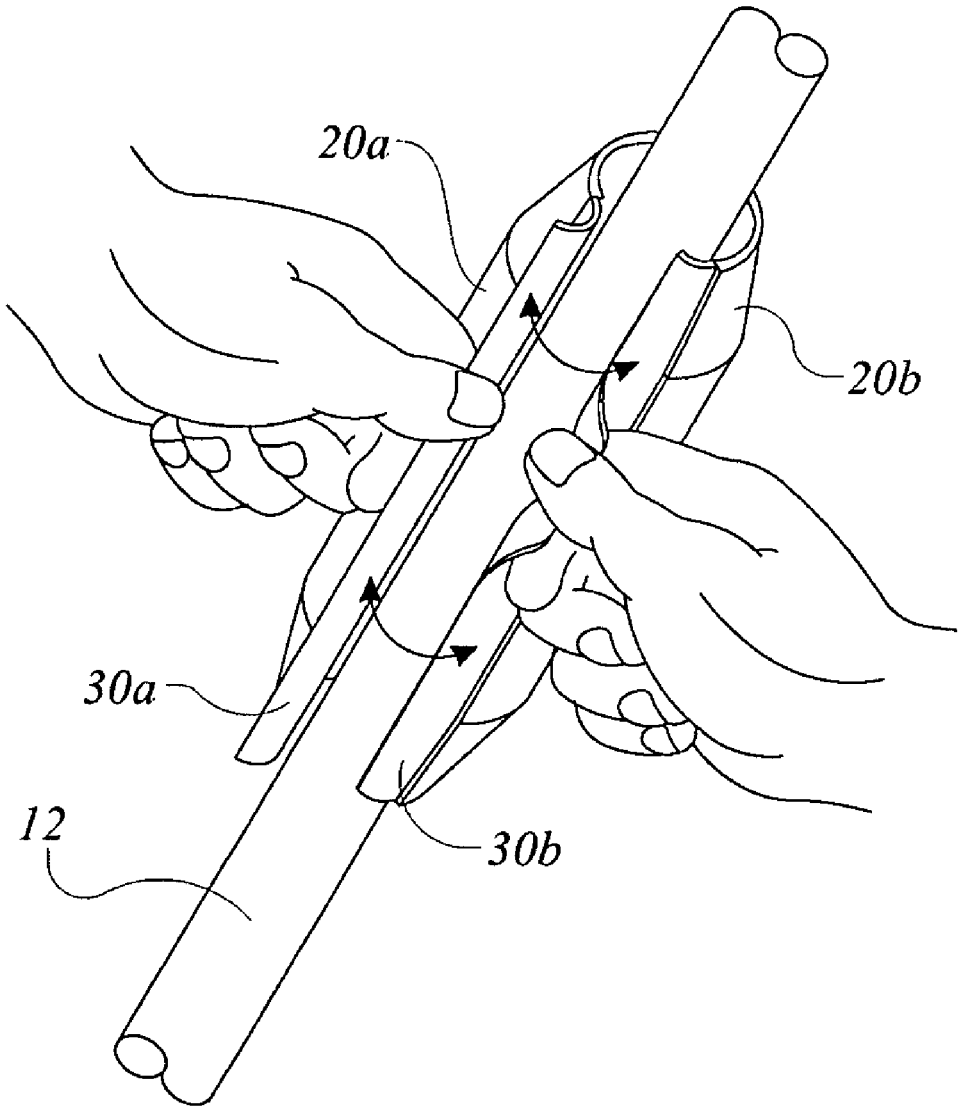
FIG. 2 is close-up perspective view of the weight with the securing means released and the weight in a partially opened state for removal from the shaft.
Figure 3:
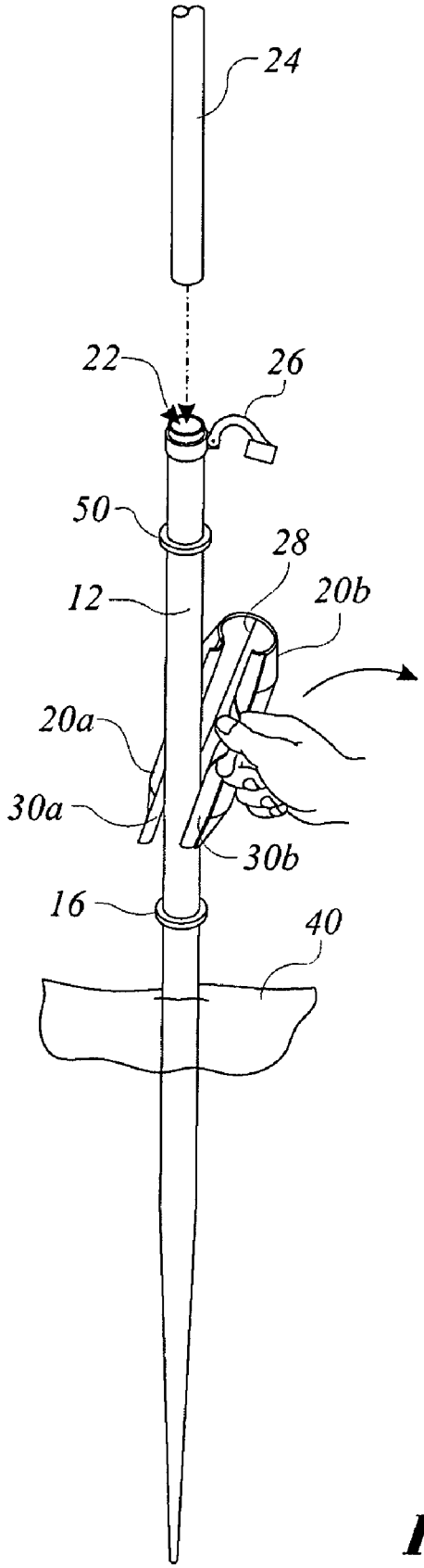
FIG. 3 is a perspective view of the driving apparatus of the present invention with the weight in an opened state and detached.

The half-sections 20*a* and 20*b*, comprising the weight, are shown in FIG. 2. Each of the half-sections 20*a* and 20*b* has an interior surface and an exterior surface. Each interior surface includes a recess designed to receive a portion of the shaft 12. The half-sections 20*a* and 20*b* are assembled in a closed state by aligning the interior surfaces in facing relation such that the recesses cooperate to receive the shaft 12. Attaching means are provided for joining the half-sections 20*a* and 20*b* to encircle the shaft 12 and retain the half-sections 20*a* and 20*b* in freely slidable engagement, on the shaft 12. Attaching means preferably include a hinge 28, shown in FIG. 3, and securing means. The hinge 28 is preferably configured for joining the half-sections 20*a* and 20*b*, and providing articulation between the closed state, shown in FIG. 1, and an open state, shown in FIG. 3, in the manner of a clamshell. The securing means is preferably provided by a hook and loop closure having a hook panel 30*a* and a loop panel 30*b*, located opposite the hinge 28, for selectively preventing articulation and retaining the half-sections 20*a* and 20*b* in the closed state. The hinge 28 is preferably formed by aligning the half-sections 20*a* and 20*b* with interior surfaces in adjacent relation and applying a coating of flexible plastic, such as polyethylene, over the exterior surface of the half-sections 20*a* and 20*b* to join the half-sections 20*a* and 20*b*, as a composite, and to form the hinge 28 of a web of plastic extending between the half-sections 20*a* and 20*b*. The hook panel 30*a* and a loop panel 30*b* are attached to adjacent portions of the plastic coating, on half-sections 20*a* and 20*b*, respectively, opposite the hinge 28, as shown in FIGS. 2 and 3. The hook and loop closure may be attached, to the coating, by gluing, plastic welding, or other conventional means.

Alternatively, the weight may comprise a single element; with attaching means comprising a central through bore for receiving the shaft 12. In a single element embodiment, the weight is not detachable. As another alternate embodiment, the weight, assembled as a composite, may include more than two sections, with all sections being aligned and coated with plastic, to produce a plurality of sections co joined by webs of flexible plastic and surrounding the shaft 12. Additionally, the sections, half-sections, and single element may be hollow and may contain one or more free pellets, preferably formed of lead, for enhancing the impact from a hammering blow received by the anvil 16, from the weight.

As set forth above the anvil assembly preferably consists of a single anvil 16, which is formed as a close fitting collar surrounding the shaft 12 and having a flat upper surface for receiving blows from the weight. The anvil 16 is preferably formed of aluminum, steel, or other metal or metal alloy. The anvil 16 is preferably formed integrally with the shaft 12 or may be securely attached to the shaft 12 by welding or other process selected to firmly bond the anvil 16 to the shaft 12 so that the kinetic energy from a blow delivered by the weight will be elastically transferred to the shaft 12. Alternatively, the anvil assembly may consist of other arrangements such as a plurality of anvils arranged circumferentially, in a radial array, on the shaft 12.

Figure 4:
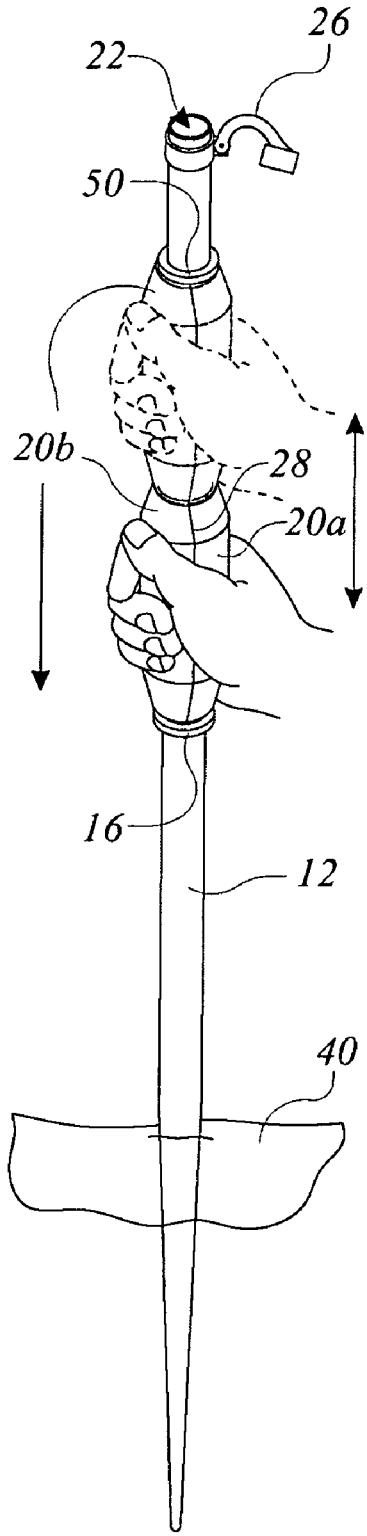
FIG. 4 is a perspective view of the driving apparatus of the present invention illustrating manual downward hammering.
Figure 5:
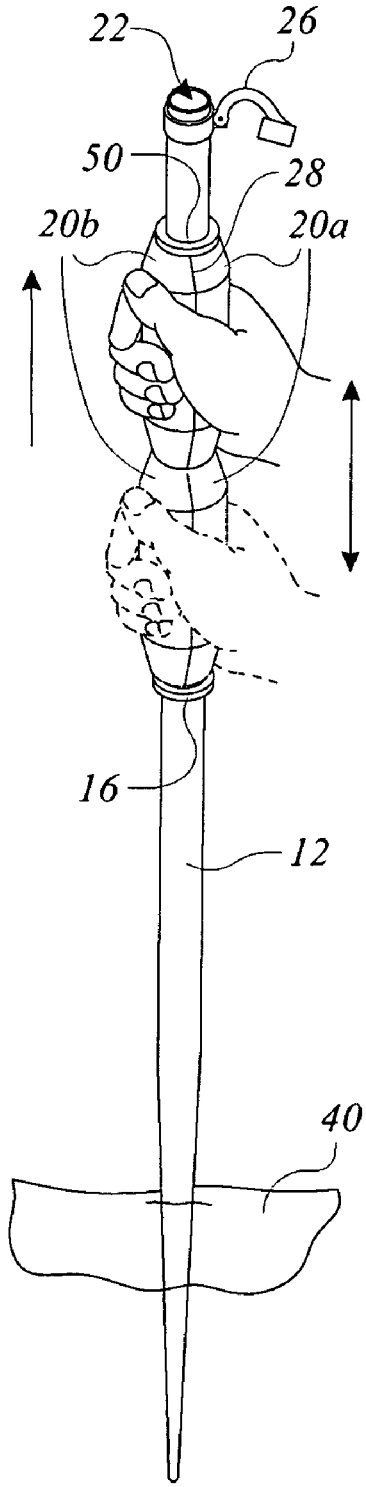
FIG. 5 is a perspective view of the driving apparatus of the present invention illustrating manual upward hammering.

In use, the apparatus may be operated to plant the shaft 12 in a granular base such as beach sand 40. It is intended that the shaft 12 serve to support a beach umbrella or other temporary structure to be used during a visit to a beach. The shaft 12 may be positioned in vertical orientation with the tapered end adjacent to the base, at a desired location. The weight may be attached to the shaft 12 at a location above the anvil 16, by opening the weight, placing the recesses adjacent to the shaft 12, closing the weight, and fastening the hook and loop closure. The weight may be repeatedly propelled against the anvil 16 to drive the shaft 12 into the beach sand 40. It is preferred that the weight, comprising a composite of joined half-sections 20*a* and 20*b* have an elongate shape extending parallel with the shaft 12 and have tapered ends for focusing the impulse of a hammering blow onto the anvil 16. The weight may be lifted by an upward sliding movement along the shaft, and may be allowed to fall upon the anvil 16 or may be lifted and forcibly directed onto the anvil 16, as shown in FIG. 4 by a single headed arrow. The upward and downward movements may be repeated in a hammering process, as shown by the double-headed arrow. It is preferred that a stop assembly be provided to limit the upward travel of the weight along the shaft. The stop assembly may consist of a stop ring 50 disposed on the shaft 12 at a location above the anvil 16 and spaced apart at a distance selected to limit the upward travel of the weight providing sufficient latitude of movement to effectively drive the shaft 12, shown in FIGS. 1, 3, 4, and 5. It is also preferred that the stop ring 50 be formed in the same manner as the anvil 16 so that the weight may be propelled upwardly against the stop ring 50 to facilitate removal of the shaft 16 from the beach sand 40, as shown in FIG. 5, by the single headed arrow.

The invention contemplates that the shaft 12 serves as a lower portion of a two part support member for an umbrella or other temporary structure with the opening 22 receiving the central pole 24 of the upper portion of a beach umbrella or other article and the latch 26 retaining the two parts as a single structure. The apparatus of the present invention may be operated with the upper portion in place or removed to suit the convenience of the user. The apparatus of the present invention may also be incorporated into a single part shaft of an article to be supported on a granular base. The invention may be incorporated into the shaft of a variety of articles, such as supports for sporting equipment nets or flagpoles. When the articles are in use or are being carried, the weight may be attached on the shaft or may be detached, at the convenience of the user.

While the preferred embodiments of the invention have been described above, it will be recognized and understood that various modifications can be made in the invention and the appended claims are intended to cover all such modifications which may fall within the spirit and scope of the invention.

What is claimed is:

1. A driving apparatus for planting a shaft of an article in a granular base, said driving apparatus comprising:

an anvil assembly, a weight, and attaching means;

said anvil assembly being fixedly disposed on an intermediate portion of said shaft;

said shaft being in generally vertical orientation and having a tapered lower end;

said weight being retained on said shaft above said anvil assembly in freely slidable engagement by said attaching means;

whereby said shaft may be positioned with said tapered end adjacent to said granular base and said weight may be repeatedly propelled against said anvil assembly, for driving said shaft into said base;

wherein:

said weight comprises a pair of half-sections each having an interior surface with a recess;

said half-sections being assembled in a closed state with interior surfaces adjacent, and said recesses cooperating to receive said shaft;

said attaching means comprising a hinge and securing means;

said hinge joining said half-sections for respective articulation between an opened state and said closed state;

said securing means being mounted on said weight and being adapted to selectively prevent articulation of said half-sections, in a closed state.

2. The driving apparatus of claim 1, wherein said half-sections are iron, steel, aluminum, or plastic.

3. The driving apparatus of claim 1, wherein:

said hinge comprises a web formed of flexible plastic;

said securing means comprises a hook and loop closure.

4. The driving apparatus of claim 1, wherein:

said half sections each consist of a hollow body containing one or more free pellets, for enhancing the impact in a hammering movement.

5. The driving apparatus of claim 4, wherein said free pellets are formed of lead.

6. The driving apparatus of claim 1, further comprising a stop assembly fixedly disposed on said shaft above said weight and spaced apart from said anvil assembly;

and wherein said anvil assembly and said stop assembly each comprise a circular collar formed of steel or aluminum;

whereby said weight may be repeatedly propelled against said stop assembly for removing said shaft from said base.

7. A driving apparatus for planting a shaft of an article in a granular base, said driving apparatus comprising:

an anvil assembly, a weight comprising a single element, and attaching means, said attaching means comprising a through bore provided in said element, and said through bore is sized for receiving said shaft;

said element comprises a hollow body containing one or more free pellets for enhancing the impact of a hammering movement;

said anvil assembly being fixedly disposed on an intermediate portion of said shaft;

said shaft being in generally vertical orientation and having a tapered lower end;

said weight being retained on said shaft above said anvil assembly in freely slidable engagement by said attaching means; and whereby said shaft may be positioned with said tapered end adjacent to said granular base and said weight may be repeatedly propelled against said anvil assembly, for driving said shaft into said base.

8. The driving apparatus of claim 7, wherein said element is formed of iron, steel, aluminum, or plastic.

9. The driving apparatus of claim 7, wherein said free pellets are formed of lead.

10. In an article having a shaft, for planting in a granular base, to support said article, a driving apparatus comprising:

an anvil assembly, a weight, and attaching means;

said anvil assembly being fixedly disposed on an intermediate portion of said shaft;

said shaft being in generally vertical orientation and having a tapered lower end;

said weight being retained on said shaft above said anvil assembly in freely slidable engagement by said attaching means;

said weight comprises a pair of half-sections each having an interior surface with a recess;

said half-sections being assembled in a closed state with interior surfaces adjacent, and said recesses cooperating to receive said shaft;

said attaching means comprising a hinge and securing means;

said hinge joining said half-sections for respective articulation between an opened state and said closed state;

said securing means being mounted on said weight and being adapted to selectively prevent articulation of said half-sections, in said closed state; and whereby said shaft may be positioned with said tapered end adjacent to said granular base and said weight may be repeatedly propelled against said anvil assembly, for driving said shaft into said base.

11. The driving apparatus of claim 10, wherein said half-sections are iron, steel, aluminum, or plastic.

12. The driving apparatus of claim 10, wherein:

said hinge comprises a web formed of flexible plastic;

said securing means comprises a hook and loop closure.

13. The driving apparatus of claim 10, wherein:

said half sections each consist of a hollow body containing one or more free pellets, for enhancing the impact in a hammering movement.

14. The driving apparatus of claim 13, wherein said free pellets are formed of lead.

15. The apparatus of claim 10, wherein:

said weight comprises a single element;

said attaching means comprises a through bore provided in said element;

said through bore being sized for receiving said shaft.

16. The driving apparatus of claim 15, wherein said element is formed of iron, steel, aluminum or plastic.

17. The driving apparatus of claim 15, wherein:

said element comprises a hollow body containing one or more free pellets for enhancing the impact of a hammering movement.

18. The driving apparatus of claim 17, wherein said free pellets are formed of lead.

19. The driving apparatus of claim 10, further comprising a stop assembly fixedly disposed on said shaft above said weight and spaced apart from said anvil assembly; and wherein said anvil assembly and said stop assembly each comprises a circular collar formed of steel or aluminum;

whereby said weight may be repeatedly propelled against said stop assembly for removing said shaft from said base.

* * * * *